US006874430B1

(12) United States Patent
McCandless

(10) Patent No.: US 6,874,430 B1
(45) Date of Patent: Apr. 5, 2005

(54) STATIONARY POWER TOOL EXTENSION TABLE

(76) Inventor: Daniel Robert James McCandless, 6654 Catamaran St., San Jose, CA (US) 95119

( * ) Notice: Subject to any disclaimer, the term of this patent is extended or adjusted under 35 U.S.C. 154(b) by 310 days.

(21) Appl. No.: 10/230,720

(22) Filed: Aug. 29, 2002

Related U.S. Application Data

(60) Provisional application No. 60/348,206, filed on Oct. 29, 2001.

(51) Int. Cl.[7] ..... A47B 13/08
(52) U.S. Cl. ..... 108/90; 108/65
(58) Field of Search ..... 108/90, 98, 152, 108/26, 25, 65, 42, 47, 49, 69, 73, 83, 143; 312/21, 29, 30; 112/258, 260, 217.1

(56) References Cited

U.S. PATENT DOCUMENTS

| | | | | |
|---|---|---|---|---|
| 1,012,856 A | | 12/1911 | Irving | |
| 2,483,106 A | | 9/1949 | Santley et al. | |
| 2,569,729 A | * | 10/1951 | Lewis | 108/97 |
| 2,958,304 A | * | 11/1960 | Arbib | 112/260 |
| 3,062,605 A | | 11/1962 | Cannon | |
| 3,745,952 A | | 7/1973 | Giesselmann | |
| 4,044,700 A | | 8/1977 | Aeschliman | |
| 4,058,072 A | | 11/1977 | Ishikawa et al. | |
| 4,114,548 A | * | 9/1978 | Kasahara et al. | 112/258 |
| 5,368,266 A | * | 11/1994 | Allen | 108/47 |

FOREIGN PATENT DOCUMENTS

| | | | | |
|---|---|---|---|---|
| JP | 01317478 A | * | 12/1989 | D05B/75/00 |

* cited by examiner

*Primary Examiner*—Jose V. Chen
(74) *Attorney, Agent, or Firm*—Jack Lo

(57) ABSTRACT

A stationary power tool extension table includes a transparent support plate for positioning against a first side of a built-in table on a stationary power tool. Side plates are connected to an edge of the support plate for positioning against adjacent sides of the built-in table. The support plate is hinged to a frame with an open top and an open bottom. Height adjustable legs are attached to the frame for positioning the support plate level with the built-in table. Slide connectors on the frame and the side plates connect the side plates to the support plate, and enable the side plates to slide horizontally against the sides of the built-in table. A removable tray is supported within the frame by a flange around the bottom of the frame. When the tray is removed, a light may be positioned under the support plate to illuminate a work piece from below.

6 Claims, 2 Drawing Sheets

STATIONARY POWER TOOL EXTENSION TABLE

CROSS REFERENCE TO RELATED APPLICATION

I claim the benefit of provisional application 60/348,206 filed on Oct. 29, 2001.

BACKGROUND OF THE INVENTION

Field of the Invention

The invention broadly relates to extension tables for stationary power tools with small built-in tables. 2.Prior Art Stationary power tools, such as sewing machines, drill presses, jig saws, etc., are typically provided with a built-in table under or around the tool bit for supporting a work piece. Such tables are generally too small for supporting anything except small work pieces. Larger work pieces are more difficult to be positioned stably or maneuvered on the small tables. For example, on a drill press, a larger rigid work piece will tend to wobble on the table. On a sewing machine, a larger piece of fabric will drape down the sides of the table and be difficult to rotate on the table and stitch in a different direction. Some stationary power tools, such as floor standing models, are provided with larger tables, but such tables cannot be compacted or disconnected for storage. Although add-on extension tables are known, they are each made to fit a predetermined power tool, so that they are relatively expensive to manufacture and stock, and they are only available for a limited number of stationary power tools.

BRIEF SUMMARY OF THE INVENTION

Accordingly, the primary object of the present extension table is to provide an enlarged work area around the built-in table of a stationary power tool.

Another object is be retrofittable to a conventional stationary power tool.

Another object is to be adjustable to fit stationary power tools of different sizes and shapes.

Another object is to provide storage space for tools and supplies.

Still another object is to illuminate the work piece from below.

The present stationary power tool extension table includes a transparent support plate for being positioned against a first side of a built-in table on a stationary power tool. Side plates are connected to an edge of the support plate for being positioned against adjacent sides of the built-in table. The support plate is hinged to a frame with an open top and an open bottom. Height adjustable legs are attached to the frame for positioning the support plate level with the built-in table. Slide connectors on the frame and the side plates connect the side plates to the support plate, and enable the side plates to slide horizontally against the sides of the built-in table. A removable tray with divided compartments is supported within the frame by a flange around the bottom of the frame. When the tray is removed, a light may be positioned under the support plate to illuminate a work piece from below.

Figure 1:
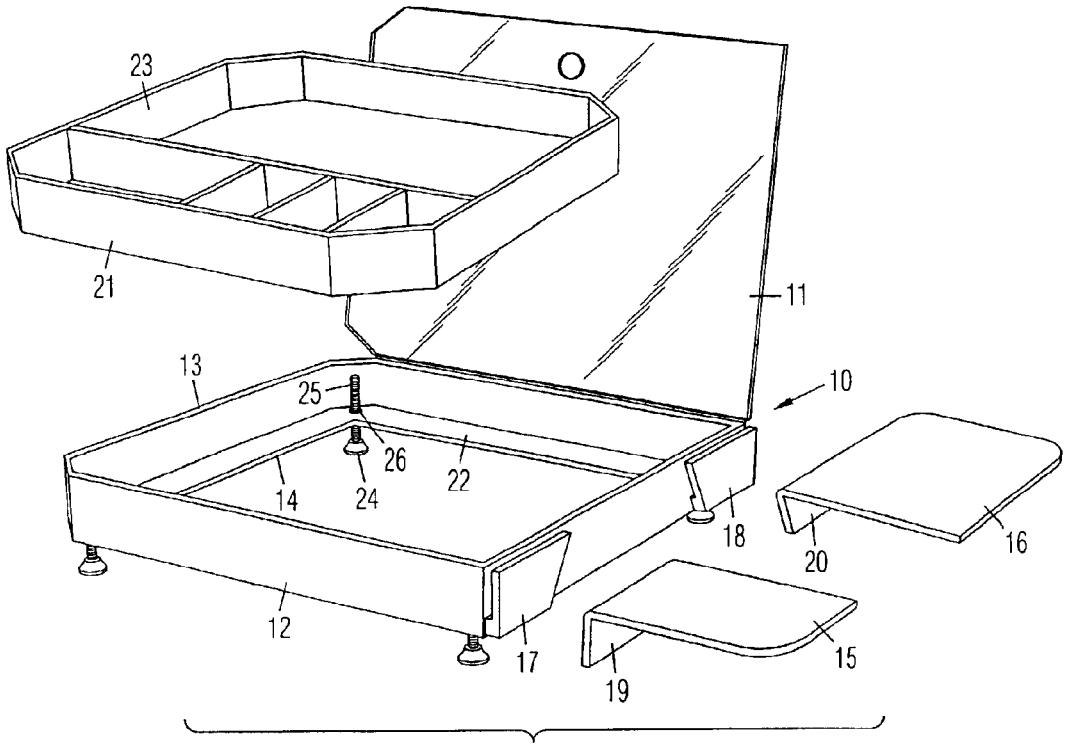
FIG. 1 is an exploded view of the present stationary power tool extension table.

| DRAWING REFERENCE NUMERALS | |
|---|---|
| 10. Extension Table | 11. Support Plate |
| 12. Frame | 13. Open Top |
| 14. Open Bottom | 15. First Side Plate |
| 16. Second Side Plate | 17. Slide Connector |
| 18. Slide Connector | 19. Slide Connector |
| 20. Slide Connector | 21. Tray |
| 22. Flange | 23. Compartment |
| 24. Leg | 25. Threaded Shaft |
| 26. Threaded Hole | 27. Notch |
| 28. Built-In Table | 29. Power Tool |

DETAILED DESCRIPTION OF THE INVENTION

FIG. 1

A preferred embodiment of a stationary power tool extension table 10 is shown in an exploded view in FIG. 1. It includes a support plate 11 hinged to a frame 12 with an open top 13 and an open bottom 14. Support plate 11 is preferably translucent for passing light, and may be diffusing or completely transparent. First and second side plates 15 and 16 are arranged for connecting to a side of support plate 11 in coplanar positions. In this example, the first and second side plates are respectively shown as the left and right side plates, but they may be reversed. First slide connectors 17 and 18 are attached to the side of frame 12 for connecting with second slide connectors 19 and 20 on respective side plates 15 and 16. In this example, slide connectors 17 and 18 are generally L-shaped brackets, and slide connectors 19 and 20 are generally down-turned brackets. Side plates 15 and 16 are thus connected to support plate 11 and horizontally movable relative to support plate 11. A storage tray 21 is for being detachably supported within frame 12 by a flange 22 around open bottom 14 of frame 12.Tray 21 is preferably provided with divided compartments 23 for storing tools and supplies. Height adjustable legs 24 are attached to frame 12 for adjusting the height of support plate 11. Support plate 11 is thus connected to legs 24.Legs 24 preferably include threaded shafts 25 which are threaded through threaded holes 26 in flange 22.

Alternatively, support plate 11 may be fixedly attached to frame 12, or it may be completely removable from frame 12. Support plate 11 may be opaque. Slide connectors 17 and 18 may be attached directly to support plate 11 for connecting supporting plate 11 directly to side plates 15 and 16. One of side plates 15 or 16 may be fixedly attached to support plate 11, and other one may be movably connected to support plate 11 with horizontal slide connectors. Legs 24 may be attached directly to support plate 11. The bottom of frame 12 may be closed. Also, slide connectors 17–20 may be of any suitable shape.

FIG. 2

Figure 2:
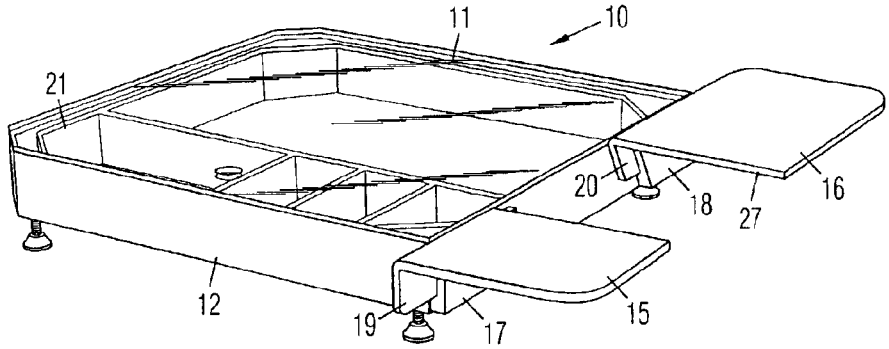
FIG. 2 is a side perspective view thereof when assembled.

In FIG. 2, tray 21 is positioned within frame 12, and support plate 11 is closed on top of frame 12. Side plates 15 and 16 are connected to support plate 11 with slide connectors 17–20 in a coplanar relationship. Side plates 15 and 16 are spaced apart from each other, and cooperate with support plate 11 to define a generally rectangular notch 27. Side plates 15 and 16 are linearly movable relative to each other to vary the width of notch 27. Tray 21 may be removed and a light (not shown) positioned under frame 12 for illuminating a work piece through translucent support plate 11.

FIG. 3

Figure 3:
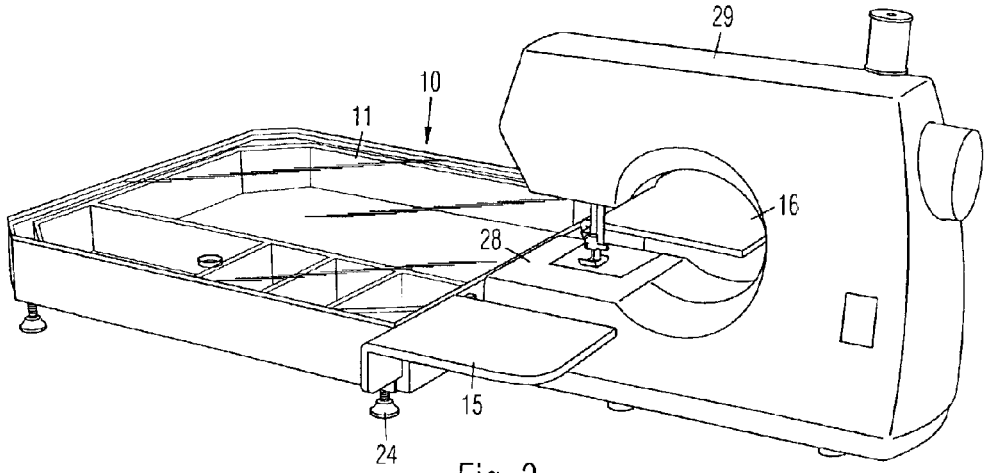
FIG. 3 is a side perspective view thereof when positioned against a stationary power tool.

Extension table is shown in FIG. 3 positioned around a built-in table 28 of a prior art stationary power tool 29.

Although power tool 29 is shown as a sewing machine in this example, it may be any type of power tool with a built-in table for supporting a work piece. Support plate 11 is positioned against an end of built-in table 28, and side plates 15 and 16 are positioned adjacent respective sides of built-in table 28. Side plates 15 and 16 are movable horizontally toward or away from each other for admitting a built-in table of any size up to a predetermined limit. Legs 24 are adjusted in height to position support plate 11 and side plates 15 and 16 level with built-in table 28. Extension table 10 is thus arranged to provide an enlarged work area around relatively small built-in table 28. Extension table 10 is thus able to fit stationary power tools with built-in tables of different sizes and heights.

FIG. 4

Figure 4:
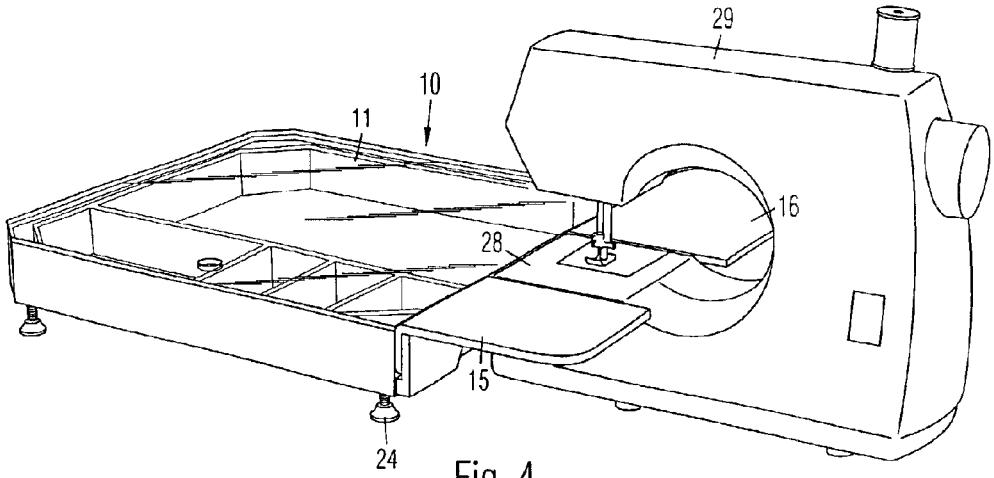
FIG. 4 is a side perspective view thereof when adjusted to fit the stationary power tool.

Extension table 10 is shown in FIG. 4 with side plates 15 and 16 clamped around built-in table 28 of stationary power tool 29. Side plates 15 and 16 are moved toward each other until they engage respective sides of built-in table 28. Alternatively, if one side plate 15 or 16 is fixedly attached to support plate 11, only the other side plate needs to be moved to clamp against built-in table 28.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A stationary power tool extension table, comprising:

a support plate for being positioned adjacent a built-in table of a stationary power tool;

a first side plate and a second side plate connected to a side of said support plate for clamping against opposite sides of said built-in table, wherein said first side plate is movable horizontally for adjusting to a width of said built-in table; and height adjustable legs connected to said support plate, wherein said legs include threaded shafts which are adjustable vertically.

2. A stationary power tool extension table, comprising:

a support plate for being positioned adjacent a built-in table of a stationary power tool;

a first slide connector connected to a side of said support plate;

a first side plate and a second side plate for clamping against opposite sides of said built-in table;

a second slide connector attached to said first side plate and movably connecting said first side plate to said support plate, wherein said first side plate is movable horizontally for adjusting to a width of said built-in table; and height adjustable legs connected to said support plate, wherein said legs include threaded shafts which are adjustable vertically.

3. A stationary power tool extension table, comprising:

a support plate for being positioned adjacent a built-in table of a stationary power tool;

a first slide connector connected to a side of said support plate;

a first side plate and a second side plate for clamping against opposite sides of said built-in table; and a second slide connector attached to said first side plate and movably connecting said first side plate to said support plate; wherein said first side plate is movable horizontally for adjusting to a width of said built-in table; and wherein said first slide connector is comprised of a L-shaped bracket, and said second slide connector is comprised of a down-turned bracket.

4. A stationary power tool extension table, comprising:

a frame with an open top and an open bottom, wherein said frame is arranged for being positioned adjacent a built-in table of a stationary power tool;

a support plate hinged to said frame;

first slide connectors attached to a side of said frame;

first and second side plates for clamping against opposite sides of said built-in table;

second slide connectors respectively attached to said first and second side plates and connected to said first slide connectors for movement relative to said frame; wherein said first and second side plates are movable horizontally for adjusting to a width of said built-in table;

a storage tray detachably supported within said frame by a flange around said open bottom of said frame, wherein said tray includes divided compartments for storing tools and supplies; and height adjustable legs attached to said frame, wherein said legs include threaded shafts which are threaded through threaded holes in said flange.

5. The stationary power tool extension table of claim 4, wherein said support plate is translucent for passing light.

6. The stationary power tool extension table of claim 4, wherein said first slide connectors are comprised of L-shaped brackets, and said second slide connectors are comprised of down-turned brackets.

* * * * *